United States Patent [19]

Ishihara

[11] 3,991,518

[45] Nov. 16, 1976

[54] ADJUSTABLE LOUVER SHUTTER

[76] Inventor: Norisue Ishihara, 1941, Jindaijicho, Chofer,, Japan

[22] Filed: June 4, 1974

[21] Appl. No.: 476,199

[30] Foreign Application Priority Data

Apr. 30, 1974 Japan .....49−48440

[52] U.S. Cl. ..... 49/75; 49/64; 49/84; 160/90; 160/236

[51] Int. Cl.[2] ..... E05F 17/00; E06B 7/096

[58] Field of Search ..... 160/130, 236, 92; 49/74–92, 63, 64

[56] References Cited

UNITED STATES PATENTS

| | | | |
|---|---|---|---|
| 340,017 | 4/1886 | Stevens | 49/84 |
| 657,367 | 9/1900 | Starck | 49/88 |
| 708,618 | 9/1902 | Briggs | 49/88 |
| 952,065 | 3/1910 | Bolewicz | 49/82 |
| 2,378,591 | 6/1945 | Solis | 160/236 UX |
| 2,903,257 | 9/1959 | Perrone | 49/82 |
| 2,954,590 | 10/1960 | Dynner | 49/92 |
| 3,048,375 | 8/1962 | Walker | 160/236 |
| 3,381,601 | 5/1968 | McCabe | 49/90 |

*Primary Examiner*—Philip C. Kannan
*Attorney, Agent, or Firm*—William J. Daniel

[57] ABSTRACT

A louver shutter having a louver slat adjusting device provided with a driving member moving up and down along a supporting frame provided intermediate the side frames of the louver shutter so that, when said driving frame is moved up and down relatively with the supporting frame, a supporting shaft for each louver slat may be rocked and also including a mechanism for locking the supporting frame and driving frame.

2 Claims, 15 Drawing Figures

ADJUSTABLE LOUVER SHUTTER

This invention relates to a louver shutter with movable louver slats wherein each louver slat is made free to open and close for each adjustment of ventilation and lighting and weather-tight shielding may be also made and which is mechanically simple, durable, easy to operate and can be mass-produced at low cost. As well known, a conventional louver shutter, wherein each louver slat is fixed to a shutter frame is subject to disadvantages in that adjustment of ventilation and lighting in response to the four seasons and weather, i.e. against the wind and rain, can not be made. Further, when the louver shutter is completely closed, it will not be able to be tightly closed and therefore it will be necessary to close it with an outside door or inside curtain.

There is already a louver type blind wherein not only the adjustment of the ventilation and lighting but also a tightly closed shielding can be made. However, this blind is merely suspended outside or inside the room, is therefore not only useless for locking the door but also will rock in vain in the case of a strong wind or rainstorm and can not develop its inherent adjusting function.

An object of the present invention is to provide a louver shutter fitted with a louver slat adjusting device wherein the various disadvantages of the above mentioned conventional louver shutter and louver type blind are all eliminated and, with a simple mechanism, not only the adjustment of the ventilation and lighting but also tightly closed shielding can be accomplished and neither storm door nor curtain is required.

Figure 1:
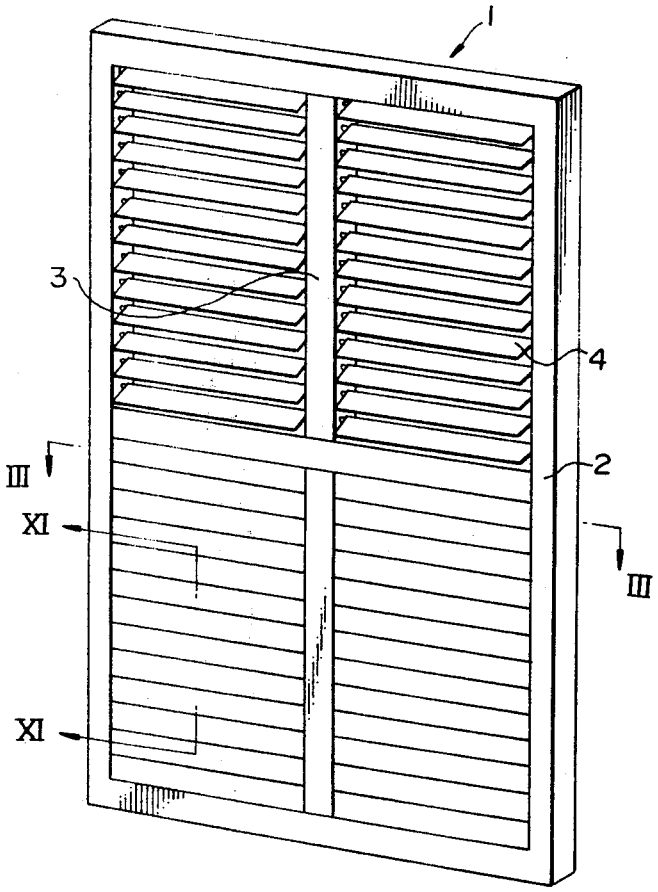
FIG. 1 is a perspective view of a louver shutter according to the present invention.
Figure 12:
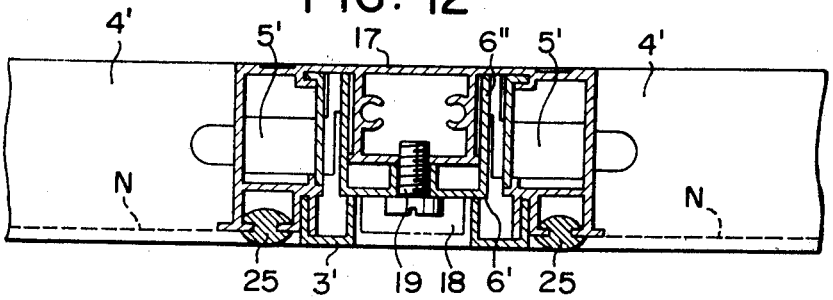
FIG. 12 is a magnified cross-sectioned view of an essential part showing the relation between the supporting shaft of the louver slat and the driving frame within an inner frame in the embodiment in FIG. 11.
Figure 2:
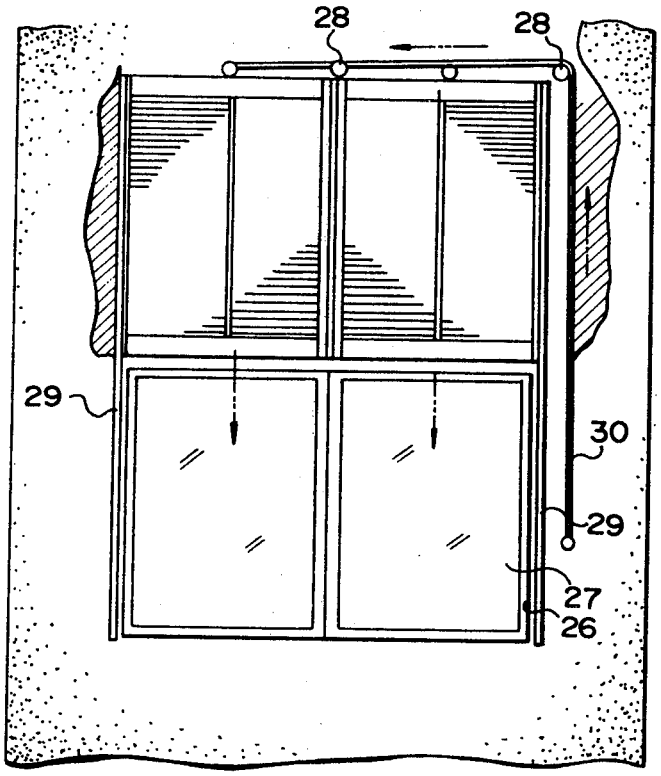
FIG. 2 is an elevation of an embodiment with the louver shutter in FIG. 1 fitted to a window part of a building.
Figure 3:
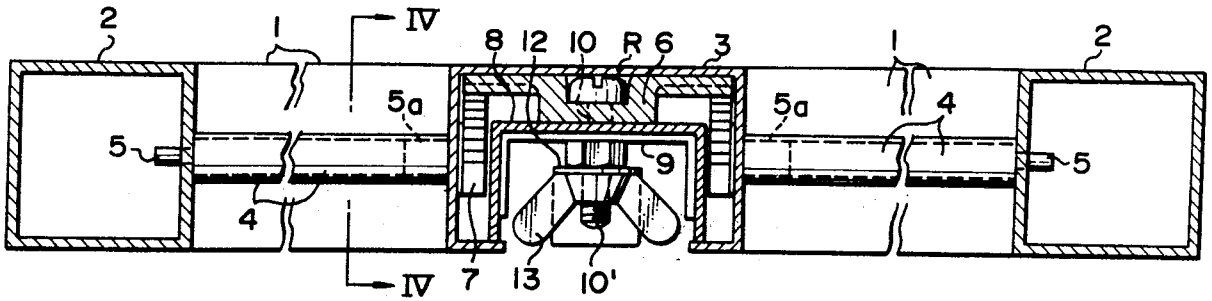
FIG. 3 is a sectioned view on line III — III in FIG. 1 showing an embodiment of the louver slat adjusting device of the present invention.
Figure 10:
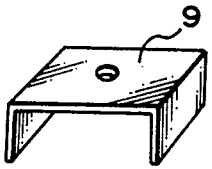
FIGS. 6 to 10 are perspective views respectively of a driving frame, semicircular gear fitted with a square-sectioned shaft, pressing frame, controlling piece erected on the lower side of the louver shutter frame and pad.
Figure 7:
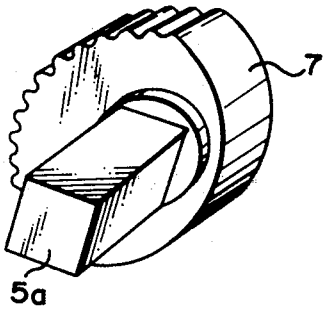
Figure 5:
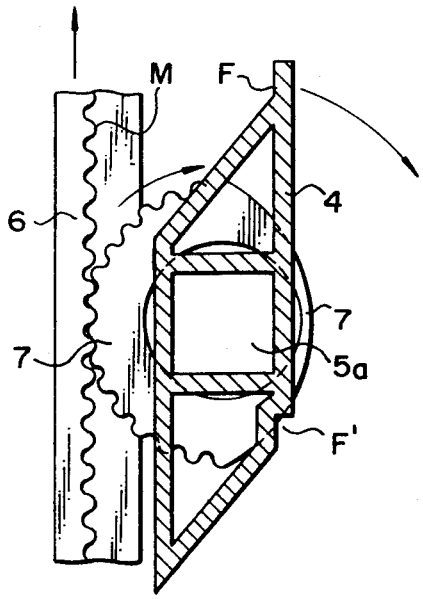
FIG. 5 is a vertically sectioned view of a louver slat showing the louver slat in the embodiment in FIG. 3 and a semicircular gear combined with it as meshed with a rack of the driving frame.
Figure 4:
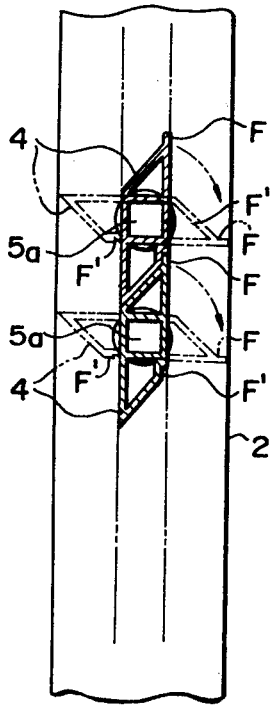
FIG. 4 is a sectioned view on line IV — IV in FIG. 3.
Figure 9:
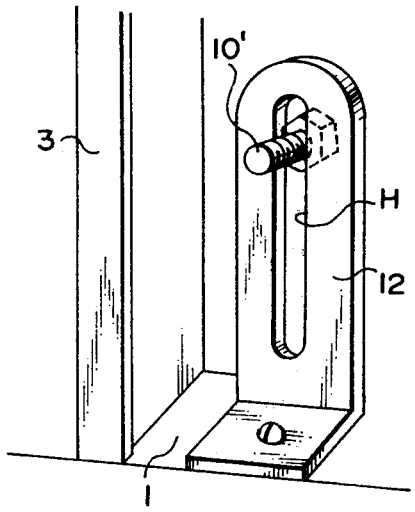
Figure 6:
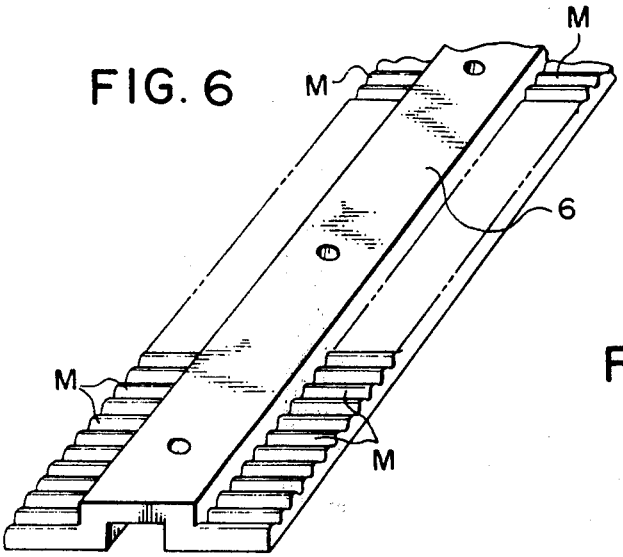
Figure 8:
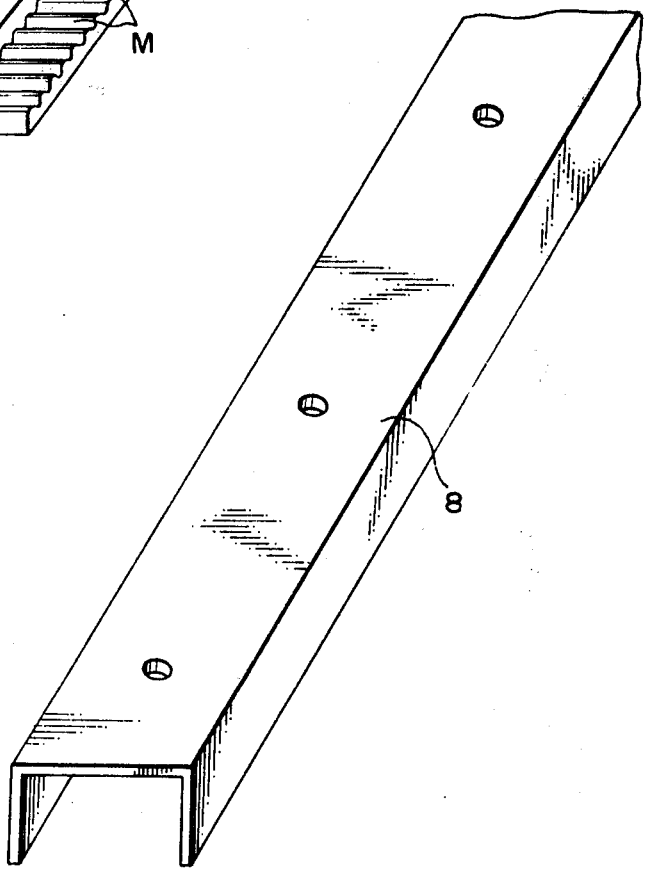

1 is a louver shutter frame made of a synthetic resin. 2 is a side frame member made of a synthetic resin of a hollow square cross-section on each side of said louver shutter frame. 3 is a supporting frame member made of a synthetic resin of horizontal channel-shaped cross-section located in a intermediate region between these side frames. 4 is a hollow long diamond-shaped louver slat also made of a synthetic resin. 5 (see FIG. 3) is a supporting shaft provided to project from the central part of the outer end of each louver slat and adapted to be inserted in a shaft hole arranged inside side frame 2. A square-sectioned supporting shaft 5*a* (see FIG. 5*a*), which projects from one side of a driven semi-circular gear 7 meshing with a rack M on each of the right and left inside surfaces of a driving frame 6 (FIGS. 3–6) vertically mounted on the inside front surface of the supporting frame 3, is inserted and fitted through a shaft hole on each side of the supporting frame 3 to support the louver slats 4 so that their upper and lower edges F and F′ may overlap with each other when in vertical position and may freely rotate outward. 8 is a square-sectioned trough-shaped pressing frame member made of a synthetic resin and fitted along the inside surface of driving frame 6 inside the supporting frame 3. Pressing frame 8 has pads 9 of a channel-shaped cross-section fitted in some places on its inside surface screws 10 are inserted from a concave recess R along the longitudinal central part of the driving frame 6 and nuts 11 screwed to them. 12 (see FIG. 9) is an L-shaped controlling piece having a vertical slot H and is erected on the lower side of the louver frame 1 corresponding to the lower end of the supporting frame 3. A long bolt 10′ fitted to the lower end of the driving frame 6 and pressing frame 8 is inserted through slot H and has a wing nut 13 screwed to the projecting end so as to be accessible for tightening and loosening. In FIG. 2, 26 is a window of a building. 27 is a glass closure fitted to the above mentioned window. 28 are pulleys fixed within the upper wall along the upper edge of the window 26. 29 is a guide rail of a channel-shaped cross-section fitted within the upper wall from each side of the window 26. 30 are ropes fitted at one end to the upper end of this louver shutter and suspended in the middle part within the room through pulleys 28.

In the embodiment of the present invention as described above, in order to incline each louver slat 4 of this louver shutter, the wing nut 13 screwed to the bolt 10′ projecting through the slot H in the controlling piece 12 is loosened and is then pushed up or down by hand. Bolt 10′ will move up or down through the slot H, and therfore the driving frame 6 inside the supporting frame 3 and held together with the pressing frame 8 with said bolt and the other upper screws 10 will also move up or down. Consequently, the semicircular gear 7 meshing with each rack M on each side of driving frame 6 will rotate as indicated by the arrow in FIG. 5, and the louver slats 4 will rotate as indicated by the respective arrows in FIGS. 4 and 5 and will be freely inclined. Therefore, when the louver slats are inclined by any desired angle, if the wing nut 13 is tightened, said angle of inclination will be held. For closing the louver shutter, the wing nut 13 is loosened and pushed down to the lower end of the slot H by gripping said wing nut, each louver slat 4 will rotate to vertical position, therefore the upper and lower edges F and F′ will be engaged with each other to be in a tightly sealed state and the inside will be shielded from the outside. (See FIG. 4.)

Now, an alternative embodiment illustrated in FIGS. 11–15 shall be detailed.

In this embodiment, the supporting frame 3 has a window hole W (see FIG. 13) made on the front surface and is made of a light metal, each louver slat 4' is made of a light metal plate bent to be substantially angled on the side, the supporting shaft 5', which is made synthetic resin and has a crank-like extension, is fitted to the inside of each of the right and left ends of each louver slat, and the square-sectioned trough-shaped driving frame 6' made of a light metal is fitted to the inside of the supporting frame 3' so as to be free to move up and down. Engaging grooves 14 for engaging the crank-like extension of the supporting shaft 5' are provided at regular intervals along the ends of the side plates 6'' of the driving frame 6'. On the front of frame 6' is a vertical guide slot 16 through which a double tube screw 15 is inserted through the driving frame 6'. 17 is (see FIG. 12) an outer frame made of a synthetic resin, fitted in the central part to the inside of the driving frame 6' and screwed with the above mentioned screw 15 so as to be integral with the supporting frame 3'. 18 is a grip provided to project from the front surface of the driving frame 6' within the window hole of the supporting frame 3'. G is a guide slot made also on the front surface of the driving frame 6' within the window hole W of the supporting frame 3'. 19 is a louver slat 4' fixing bolt screwed to the outer frame 17 through the driving frame 6' from said guide slot. h (see FIG. 15) is an inclined slot made at the end of the side plate 6'' at the lower end of the driving frame 6'. 20 is a supporting arm erected on the upper surface of the lower frame 3''. 21 is a lever pivoted at the upper end of supporting arm 20. 22 is a small shaft inserted through the front end of said lever 21 and the inclined slot h. 23 is an engaging rod pivoted at g at its upper end to the rear end of lever piece 21 and engaging and disengaging with an engaging hole S made on the surface of a doorsill 24. N (see FIG. 12) is an insect screen.

Figure 11:
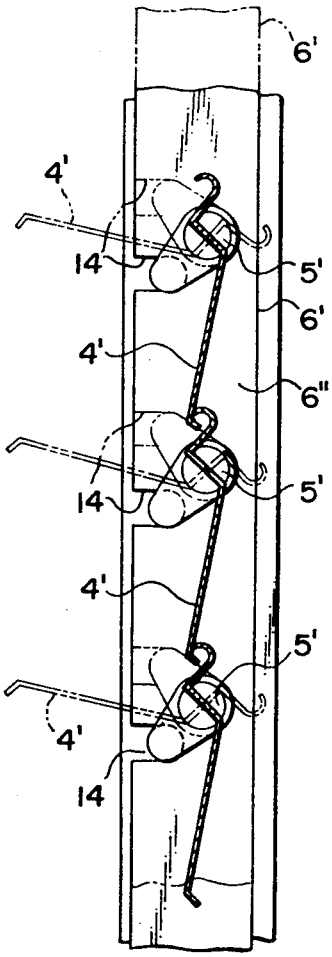
FIG. 11 is a sectioned view on line XI — XI in FIG. 1 showing another embodiment of the louver slat adjusting device of the present invention.
Figure 13:
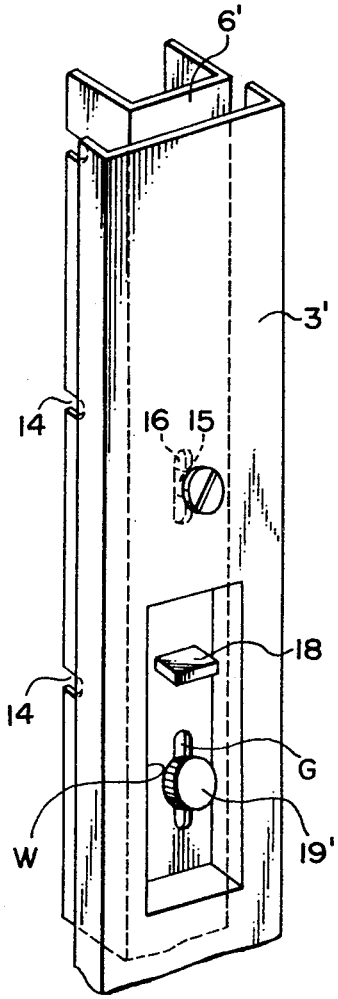
FIG. 13 is a magnified perspective view of a part of the inner frame fitted with the driving frame within it.
Figure 14:
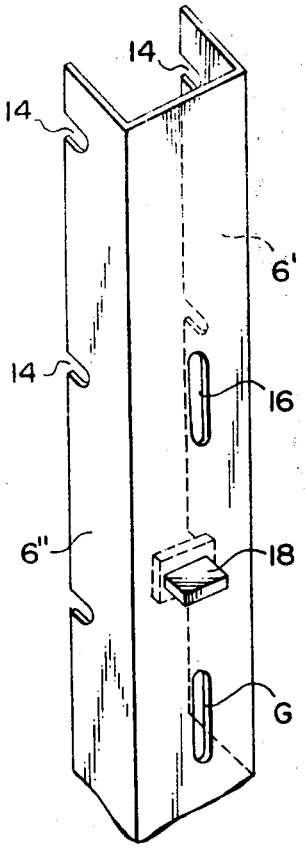
FIG. 14 is a magnified perspective view of a part of the driving frame.
Figure 15:
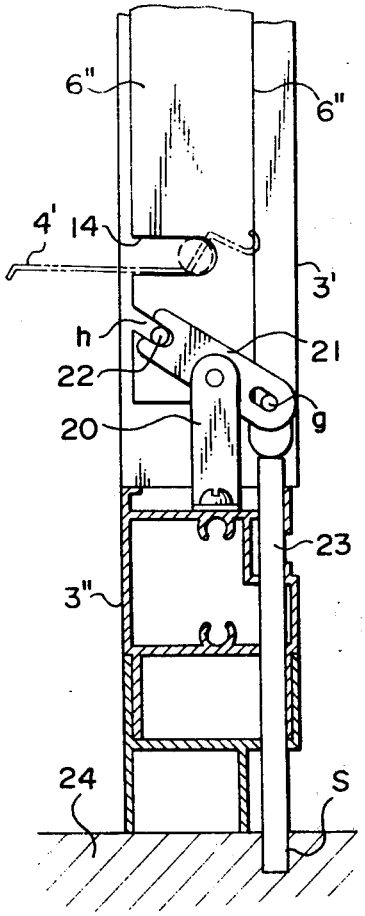
FIG. 15 is a magnified vertically sectioned view of the louver end part of the louver shutter showing a louver shutter sliding stopping device.

With this version of the louver shutter of the invention for opening the louver slats 4' from the tightly shielded state shown in FIG. 11, the grip 18 projecting on the surface within the window hole W of the supporting frame 3' inside the room (shown in FIG. 13) is pushed up, the driving frame 6' fixed to it will rise, and louver slats 4' fitted to the supporting shaft 5' engaged in the engaging groove 14 of said driving frame will rotate upward to open as shown by the broken lines in FIG. 11. Therefore, when the bolt head 19' projecting within the window hole W of the supporting frame 3' is turned, the bolt 19 will tighten with the outer frame 17 and the louver slats 4' will be held open. In this way, the louver slat 4' may be opened to any opening degree by controlling the rise of the driving frame 6' and therefore the lighting and ventilation will be freely adjusted. In such case, in response to the rise of the driving frame 6', that is, the opening of the louver slats 4', the lever 21 on the lower frame 3'' engaged with the lower end of said driving frame will rise at the front end and will lower at the rear end and therefore the engaging rod 23 will lower and will intrude at its lower end into the engaging hole S on the surface of the door-sill 24. Therefore, while the louver slats 4 are open, the louver door cannot slide to the right and left and therefore the projected louver slats 4 will not be likely to be broken. Then, for closing the louver slats 4', when the bolt head 19' is first loosened and then the grip 18 is pushed down, the driving frame 6' will be also lowered and therefore each louver slat will rotate downward and will be again perfectly closed as shown by the solid lines in FIG. 11. Then, if the bolt head 19' is again screwed, the louver slats 4' will be held closed. In such case, too, with the lowering of the driving frame 6', the engaging rod 23 will be pulled up by the lever 21 and will therefore disengage at the lower end with the engaging hole S, therefore the louver shutter will be able to be slide to the right and left on the doorsill 24. Further, in such case, the louver slats 4' will be positioned within the outer frame 17 and therefore will not be likely to be broken by colliding with the door box hole or the like. By the way, in this louver shutter, an insect screen N and glass plate (not illustrated) can be freely provided on the inside surface. Therefore, when the louver slats 4' are opened, it will be possible to prevent insects and dusts from coming in and rain water from being blown in.

In the louver shutter of the present invention, as mentioned above, by moving the driving frame 6, 6' up and down, each louver slat 4, 4' can be freely rotated and inclined, therefore the ventilation and lighting can be adjusted as desired depending on the season, weather, day or night and tight shielding can be also made. Therefore, it serves to prevent wind, rain or theft. Further, when each louver slat 4 is made hollow as in the drawings, there will be effects of noise prevention and heat insulation and therefore storm doors and troublesome room curtains can be omitted. Thus, fittings very attractive in appearance can be provided.

When the present shutter is mounted, as shown in FIG. 2, and rope 30 is disengaged, the louver shutter will lower as indicated by the arrows in FIG. 2 due to its own weight and will extend over the outer surface of the glass door 27 and, therefore, in such case, lighting adjustment and shielding will be possible. Further, when the rope 30 is pulled downward by hand or by means of a motor, the louver shutter will be pulled up above the glass door 27. Therefore, the louver shutter has double advantages that no room curtain or outside shutter is required while the glass door 27 is still protected.

What is claimed is:

1. An adjustable louver shutter adapted to fit in a door or window opening having a sill along the lower side thereof, means mounting said louver shutter in said door or window opening to permit relative movement of the louver shutter to open and close said opening, said louver shutter comprising top, bottom and side frame members, a supporting frame extending between said top and bottom frames intermediate said side frames, a driving member associated with said supporting frame for independent up and dowm movement relative thereto, a plurality of lower slats arranged between each side frame and the supporting member and journaled therein for pivotal movement about individual axes passing therethrough, a mechanical connection between each said slat and said driving member whereby movement of the latter causes a corresponding pivotal movement to open and close said slats, means for retaining said driving member in a given position relative to said supporting frame, detent means carried by said bottom frame member for movement in and out of locking engagement with said opening sill; and means actuated when said driving member is moved to pivot said slats to open position to engage said detent means with said sill, thereby preventing said louver shutter from being opened while said slats are in open position.

2. An adjustable louver shutter as in claim 1 wherein said shutter mounting means comprises sill means mounting said shutter for lateral sliding movement relative to said door or window opening.

* * * * *